US006378250B1

(12) United States Patent
Yen

(10) Patent No.: US 6,378,250 B1
(45) Date of Patent: Apr. 30, 2002

(54) DOOR GUARD

(76) Inventor: Chin-Pei Yen, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/679,837

(22) Filed: Oct. 5, 2000

(51) Int. Cl.[7] ..... E06B 1/70
(52) U.S. Cl. ..... 49/470; 49/310; 49/316
(58) Field of Search ..... 49/304, 305, 306, 49/307, 308, 309, 310, 469, 470, 70, 316; 160/40

(56) References Cited

U.S. PATENT DOCUMENTS 19,673 A * 3/1858 Bigelow
78,980 A * 6/1868 Lindsley
411,778 A * 10/1889 Bigoness
516,873 A * 3/1894 Murphy
1,802,834 A * 4/1931 Reed
2,105,164 A * 1/1938 Schlegel
6,058,654 A * 5/2000 Rossone ..... 49/314
6,195,939 B1 * 3/2001 Sowers ..... 49/310

* cited by examiner

*Primary Examiner*—Curtis A. Cohen

(57) ABSTRACT

A door guard is provided. The door guard includes a pair of positioning seats of symmetrical configuration secured to a door above the bottom of the door and a door guard releasably disposed to the positioning seats. The door guard has an upper plate made of flexible material and a lower plate made of web and connected by a connection plate. It is characterized in that the door guard may put upside-down to cope with the changing of the seasons in order to prevent the insects or the sandy wind from entering into the house.

3 Claims, 3 Drawing Sheets

DOOR GUARD

BACKGROUND OF THE INVENTION

The present invention relates to doors and more particularly to a door guard which prevents the mosquitoes, flies or other insects from entering into the house in summer time and the sands or the wind from penetrating into the house in winter time.

In the summer time, many insects such as the mosquitoes, flies grow quickly in the ditch, weeds, etc. They enter into the house to sting people. Although, there is window screen to prevent them. They may enter through the crevice under the door.

In the winter time, the sand or the chilly wind also penetrates into the crevice even that the door is closed. So that a door guard is necessary to provide under the door.

SUMMARY OF THE PRESENT INVENTION

The present invention has a main object to provide a door guard which prevents the insects such as the mosquitoes and flies from entering the crevice under a door.

Another object of the present invention is to provide a door guard which prevent the sand and the chilly wind from penetrating into the house in winter time.

Accordingly, the door guard of the present invention comprises a pair of positioning seats of symmetrical configuration secured to the lower portion of a door and a door guard releasably disposed to the seats. The guard includes an upper plate made of flexible material and a lower plate made of web. In the summer time, put the lower plate at lower position and under the door so as to prevent the insects from entering into the house. If in the winter time, make the door guard upside-down to have the upper plate at the lower position and under the door so as to prevent the sand and chilly wind from penetrating into the house.

The present invention will become more fully understood by reference to the following detailed description thereof when read in conjunction with the attached drawings.

DESCRIPTION OF THE PREFERRED EMBODIMENT

Figure 1:
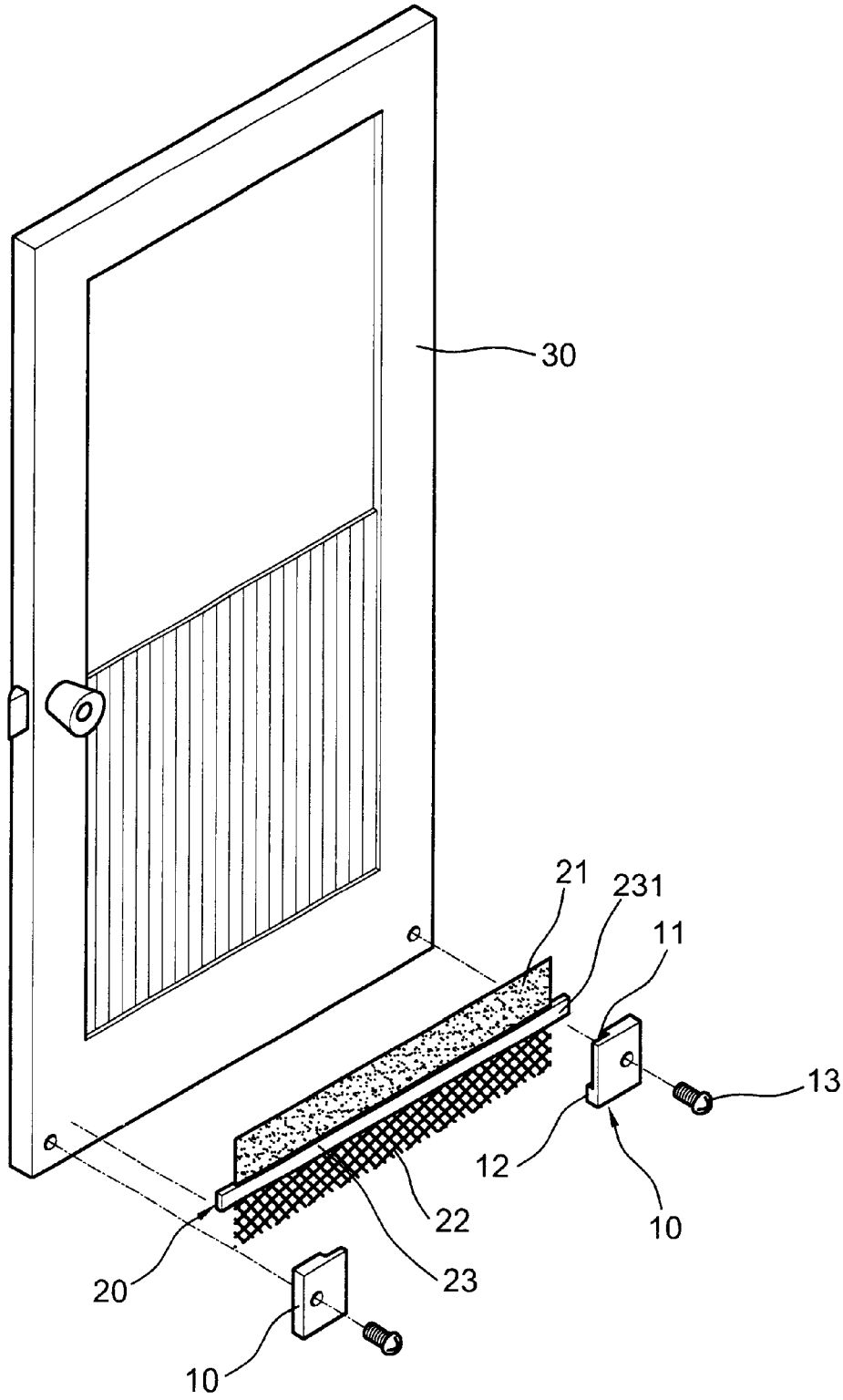
FIG. 1 is an exploded perspective view to show the door guard according to the preferred embodiment of the present invention.
Figure 2:
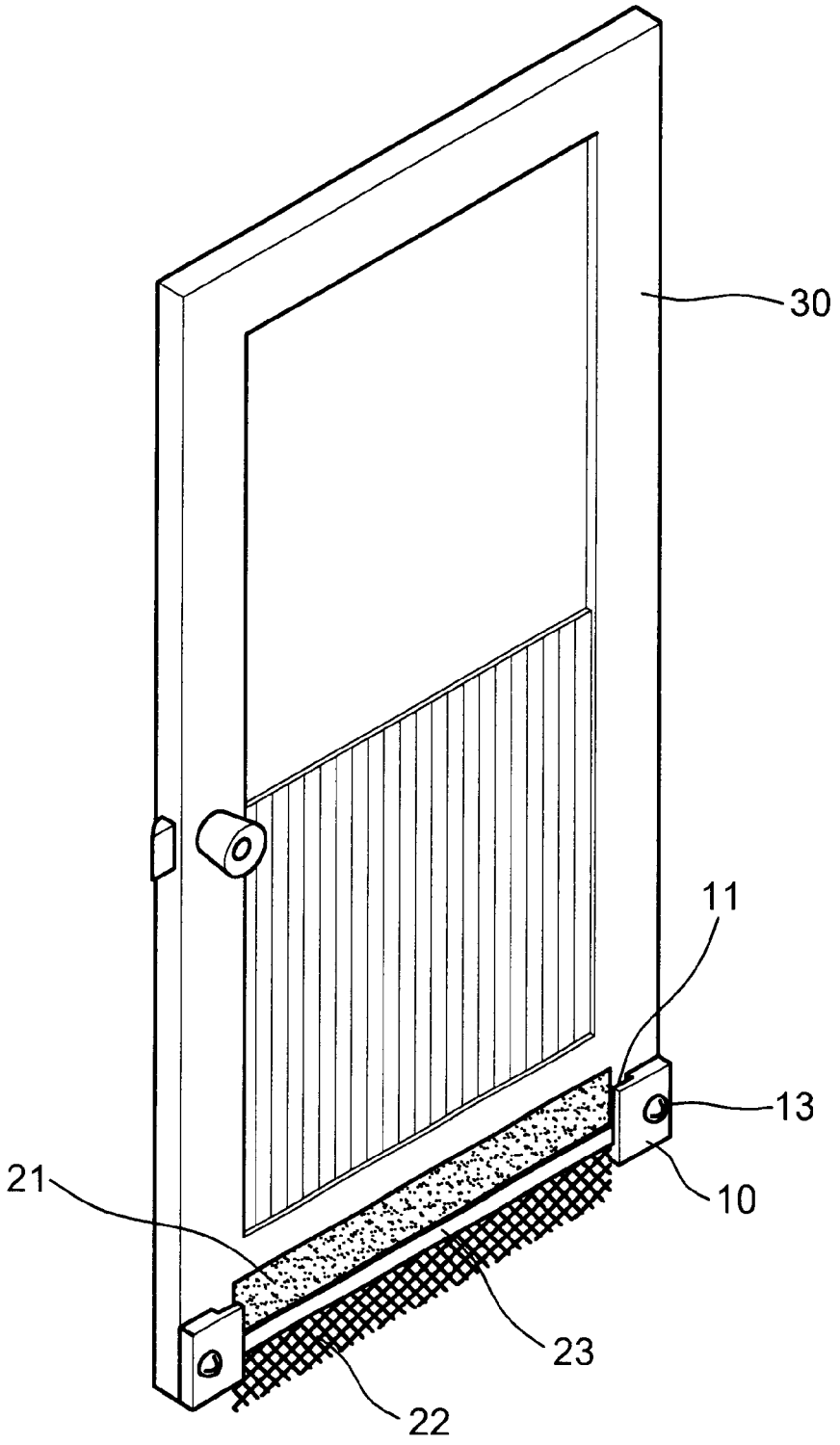
FIG. 2 is a perspective view to show the assembly of FIG. 1.

With reference to FIG. 1, the door guard of the present invention comprises generally a pair of positioning seats 10 of symmetrical configuration respectively secured to one side of a door 30 above the bottom thereof by screws 13 (as shown in FIG. 2) each having a slot 11 to define a damping 12 thereunder and a door guard 20 releasably disposed to the slots 11. The door guard 20 includes an upper plate 21 made of flexible material and a lower plate 22 made of web material connected by a connection plate 23 on their corresponding edges. The connection plate 23 has a pair of projections 231 at two ends releasably engageable within the slots 11 of the positioning seats 10.

Figure 3:
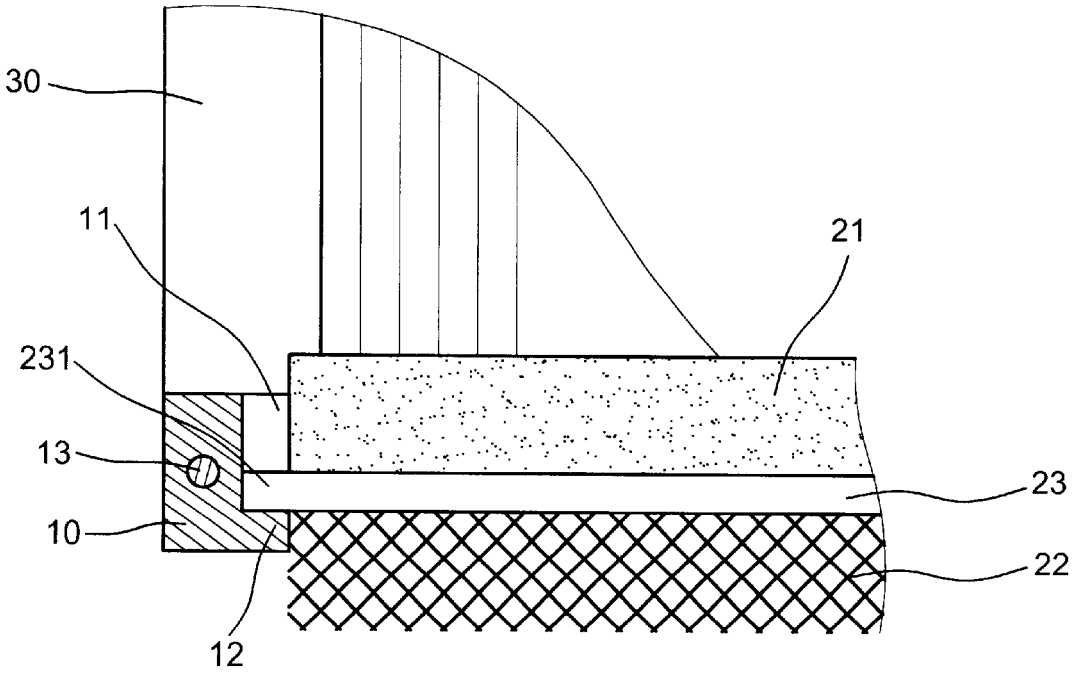
FIG. 3 is a longitudinal section of FIG. 2.
Figure 4:
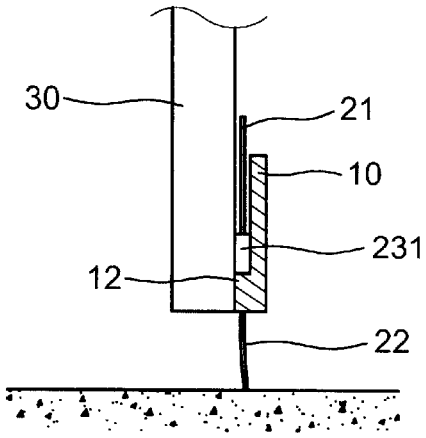
FIG. 4 is a cross section of FIG. 2.

When is in summer time, the lower plate 22 is at lower position of the guard 20 to close the crevice of the door 30 in order to prevent the insects from entering into the house (as shown in FIGS. 2, 3 and 4). When is in the winter time, the door guard is put upside-down to have the upper plate positioned at the lower position to close the crevice of the door 30 in order to prevent the sand and the chilly wind from penetrating into the house.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A door guard comprising:

a pair of positioning seats respectively secured to a side of a door above bottom thereof by screws, said positioning seats being in symmetrical configuration each including a slot to define a damping thereunder;

a door guard releasably disposed into the slots of the positioning seats, said guard having an upper plate and a lower plate connected on their corresponding edges by a connection plate which has a pair of projections at two ends respectively engaged within the slots of the seats.

2. The door guard as recited in claim 1 wherein said upper plate of the door guard is made of flexible material and said lower plate thereof is made of web material.

3. The door guard as recited in claim 1 wherein said door guard may put upside-down to cope with the changing of the seasons.

* * * * *